US007959153B2

(12) United States Patent
Franks, Jr.

(10) Patent No.: US 7,959,153 B2
(45) Date of Patent: Jun. 14, 2011

(54) PLAYING CARD SORTER AND CANCELLING APPARATUS

(75) Inventor: Thedfred E. Franks, Jr., Highland Village, TX (US)

(73) Assignee: Giesecke & Devrient America, Inc., Dulles, VA (US)

( * ) Notice: Subject to any disclaimer, the term of this patent is extended or adjusted under 35 U.S.C. 154(b) by 1021 days.

(21) Appl. No.: 11/819,353

(22) Filed: Jun. 27, 2007

(65) Prior Publication Data

US 2008/0001356 A1 Jan. 3, 2008

Related U.S. Application Data

(60) Provisional application No. 60/817,348, filed on Jun. 30, 2006.

(51) Int. Cl.
*A63F 9/00* (2006.01)

(52) U.S. Cl. ..... 273/148 R; 273/149 R; 273/151; 463/22; 463/29; 463/40; 463/47

(58) Field of Classification Search ..... 463/29, 463/40, 47, 22; 273/149, 148 R, 149 R, 151
See application file for complete search history.

(56) References Cited

U.S. PATENT DOCUMENTS

| | | | | |
|---|---|---|---|---|
| 4,733,360 | A | 3/1988 | Kobayashi et al. | |
| 4,921,109 | A | 5/1990 | Hasuo et al. | |
| 5,722,893 | A | 3/1998 | Hill et al. | |
| 5,989,122 | A | 11/1999 | Roblejo | |
| 6,010,131 | A * | 1/2000 | Myers | 273/148 R |
| 6,250,632 | B1 * | 6/2001 | Albrecht | 273/149 R |
| 6,267,248 | B1 | 7/2001 | Johnson et al. | |
| 6,403,908 | B2 | 6/2002 | Stardust et al. | |
| 6,629,894 | B1 | 10/2003 | Purton | |
| 6,676,127 | B2 | 1/2004 | Johnson et al. | |
| 6,726,205 | B1 | 4/2004 | Purton | |
| 6,886,829 | B2 * | 5/2005 | Hessing et al. | 273/149 R |
| 2005/0026681 | A1 | 2/2005 | Grauzer et al. | |
| 2005/0098952 | A1 * | 5/2005 | Ungaro et al. | 273/309 |
| 2005/0113166 | A1 | 5/2005 | Grauzer et al. | |

FOREIGN PATENT DOCUMENTS

| | | |
|---|---|---|
| DE | 29714114 | 3/1998 |
| EP | 1316341 | 4/2003 |
| GB | 2034286 | 6/1980 |
| WO | WO 00/51076 | 8/2000 |

* cited by examiner

*Primary Examiner* — Pierre Eddy Elisca
*Assistant Examiner* — Shahid Kamal
(74) *Attorney, Agent, or Firm* — Bacon & Thomas, PLLC

(57) ABSTRACT

A used card handling device includes both a card cancelling device and a card sorting unit, as well as an imaging device, a transport mechanism for transporting cards between the card imaging, cancelling, and sorting devices or units, and a controller for controlling the card imaging, cancelling, sorting, and transporting devices or units. The sorting device includes a holding device for each type of card, and output pockets to which the holding devices distribute the cards in a desired order.

16 Claims, 3 Drawing Sheets

PLAYING CARD SORTER AND CANCELLING APPARATUS

This application claims the benefit of provisional U.S. Patent Application Ser. No. 60/817,348, filed Jun. 30, 2006.

BACKGROUND OF THE INVENTION

1. Field of the Invention

This invention relates to apparatus that enables automatic cancellation and sorting of used or new playing cards, and in particular to an apparatus that collects cards following use in casino games, marks the cards so that they cannot be re-used in a casino game, and sorts the cards into decks for sale or distribution to the public.

The invention also relates to a automated used-card handling apparatus capable of verifying whether a used deck of cards are complete and cancelling/sorting or destroying the cards depending on the type of cards in the deck, the condition of the cards, and whether the deck is complete.

Finally, the invention relates to a card sorting apparatus that utilizes card escrow spools to hold cards during sorting, thereby eliminating the need for complex and relatively slow tray-moving mechanisms.

2. Description of Related Art

The gaming industry uses many decks of playing cards each day in order to maintain a high quality and integrity level of cards on each table. Cards are used for a limited time, such as one day or even one shift, and then they must be collected. Due to the possible fraud and cheating that could take place, the used cards are collected and controlled by the casino's security staff and the card management team. All cards are counted and then marked in some fashion to make sure they cannot be re-used in a live game at the casino.

The most common methods of marking the cards is to shave off card edges, or punch/drill holes in the card. The cards, which have printed designs unique to the casinos that use the cards, may then be re-packaged and made available for charity give-aways, or resale as souvenirs or collectibles. To get these decks back into full decks after the canceling process, casinos typically employ persons or contract with outside companies or state agencies, such as bureaus of prisons, to manually sort the cards into complete decks that can be packaged and sold or given away by the casinos.

Casino gaming tables are commonly assigned 6 to 12 decks of cards based on what type of game is being played. This amounts to over 600 decks of cards per day for a medium to large sized casino. The card decks are used for one 8-hour or 24-hour shift, and then collected, verified, and marked as used. If any cards are found missing the casino must switch to a new color or design of card to make the missing cards invalid in any live game. As a result, counting and sorting of cards is a significant expense for casinos.

To reduce expenses associated with card counting and sorting, it has previously been proposed to provide apparatus capable of automatically playing cards after their use in casino games. For example, U.S. Pat. No. 6,010,131 discloses an apparatus for voiding playing cards by using pairs of rotary cutting implements to deface the cards so that they cannot be re-used. However, such apparatus does not facilitate sorting of the cards for re-distribution to the public, which is a very labor-intensive process. To the contrary, the apparatus disclosed in U.S. Pat. No. 6,010,131 effectively destroys the cards and feeds them to a waste bin, with no provision for recovery of the cards, much less sorting them. The same results could be obtained by simply feeding the cards to a conventional shredder.

On the other hand, U.S. Pat. No. 6,250,632 discloses an automatic card sorter designed to shuffle cards for re-use, or to sort the cards into decks for re-distribution. To accomplish this, the apparatus identifies each of the cards and sends them into one of a plurality of trays according to a randomizing or sorting algorithm. To accommodate all shuffling and sorting possibilities, the sorter described in U.S. Pat. No. 6,250,632 is required to provide at least as many trays as the number of different cards in a deck to be sorted, or at least fifty two trays. As a result, the apparatus has the disadvantages that (i) the trays must be moved into position one at a time in a predetermined sequence, resulting in a sorting process that is relatively inefficient for many types of sorts, (ii) the large number of trays required adds to the size and complexity of the apparatus, and (iii) cancelling of the cards must be carried out manually or by a separate apparatus.

While the apparatus disclosed in U.S. Pat. No. 6,250,632 is not capable of canceling playing cards during a sort, and is mechanically inefficient, the patent does usefully point out that there are there are estimated to be "some 10,000 BLACKJACK tables in America" and that these tables use over "30 million decks each year, most being sorted back to original ('new') order by hand." Unfortunately, the patent does not appreciate that the decks must not only be sorted, but also canceled. A need clearly exists for a more efficient way to sort these decks, and to cancel the decks as well.

SUMMARY OF THE INVENTION

It is accordingly first objective of the invention to provide an apparatus that overcomes the disadvantages of the prior art, and in particular that automates various tasks associated with handling of playing cards following use in casino games, thereby reducing costs.

It is a second objective of the invention to provide an apparatus that both cancels and sorts used playing cards into decks for re-sale or distribution as souvenirs or collectibles.

It is a third objective of the invention to provide a card sorting apparatus having increased efficiency and reliability.

It is a fourth objective of the invention to provide an apparatus capable of automatically cancelling playing cards in an efficient manner, and that preserves the cards for re-distribution.

It is a fifth objective of the invention to provide an apparatus that facilitates verification of a number and condition of playing cards in a used deck, and that automatically cancels and sorts or disposes of the cards based on a result of the verification.

It is a sixth objective of the invention to provide an automatic card handling apparatus capable of transporting cards between handling stations in an efficient and reliable manner.

It is a seventh objective of the invention to provide a card handling apparatus capable of automated processing, sorting, and/or disposal of playing cards made of plastic, paper or any other suitable material.

These and other objectives of the invention are achieved by an apparatus that, in its broadest form, includes both a card cancelling and a card sorting device, an imaging device, a transport mechanism for transporting cards between the card imaging, cancelling, and sorting devices, and a controller for controlling the card imaging, cancelling, sorting, and transporting devices.

According to one aspect of a preferred embodiment of the invention, the card cancelling device includes a punch die for rapidly defacing individual cards during transport through the cancelling device, or a drill for defacing stacks of cards, while still preserving the cards for re-distribution. Those skilled in the art will appreciate, however, that other types of card cancelling devices may be substituted, including cutting devices for shaving or cutting off parts of the cards, or devices for branding or marking devices for permanently including on the cards a mark indicative of cancellation. Preferably, the cancelling device is positioned in the belt path of the transport and be engaged during sorting functions that require the cancelling of the card. In addition, a shredder may be added for use in disposing of cards in case decks are found to be incomplete or cards too damaged to be re-used.

According to another aspect of the preferred embodiment of the invention, the card sorting device is arranged to sort the cards by rank or suit into a number of trays that is smaller than the number of cards in the deck, thereby increasing sorting efficiency while simplifying the mechanical structure of the device and increasing reliability. To enable sequential sorting into decks with a minimal number of trays, the sorting device preferably uses escrow spools or other devices for holding cards while other cards are being stacked, and releasing a respective card to an appropriate pocket when the stack in the tray is ready to receive the card.

In the preferred embodiments, the imaging device and controller may be used to identify individual cards, not only for the purpose of sorting the cards, but also for purposes of card counting to ensure that decks are complete and grading of cards to verify whether the cards can be re-used, in the case of plastic cards, or re-packaged in the case of paper cards.

It will of course be appreciated by those skilled in the art that the invention is not limited to use in "casinos" or other establishments dedicated to gambling, or to traditional playing cards, but rather that the invention may be used in any establishment having a need to cancel and sort cards of any type.

According to a particularly preferred, but not exclusive, embodiment of the invention, the card sorting and cancelling apparatus is adapted to be used in a secure card room of a casino to verify, cancel, and sort incoming and outgoing decks of cards. New decks of cards are placed on a feeder and the apparatus processes them to a single pocket to verify that the entire deck is there. The apparatus is programmed to identify all types of decks including card, plastic, and any other variations the casino is using including design changes and color makeup. The apparatus preferably stores the results for each deck to provide an electronic trail of the verification process, and/or prints out the results to provide a paper trail.

Used decks that are returned to the card room are processed by the apparatus to verify the completeness of each deck. The apparatus is designed to process multiple mixed decks and separate them into the stacking pockets based on a predetermined sorting routine picked by the casino and the operator. For instance the common multi-deck-playing table has 6 decks mixed all together. The apparatus is able to load the entire stack of cards and sort them into individual pockets by complete deck or complete suit.

According to an especially advantageous feature of the invention, the sorting and cancelling apparatus is modular in design and can be configured to have as many pockets as required to meet sorting requirements in as few passes as possible. The common configuration would be 16 pockets or trays to allow the separation of each different card. The apparatus preferably will also have the ability to sort based on the suit of each card, including but not limited to clubs, diamonds, hearts, and spades.

In addition to sorting decks of cards, the apparatus of the preferred embodiments may also be adapted to identify header cards for separating decks into groups, for example, decks originating from different gaming tables. The header cards may include barcodes for identification by an appropriate barcode reading device, or other markings for identification by appropriate scanning or imaging devices and/or software. Escrow spools and trays may be provided or adapted, as necessary, to accommodate the header cards.

Finally, according to yet another aspect of the preferred embodiment of the invention, the cancelling and sorting apparatus is capable of handling not only conventional paper cards, but also reusable playing cards. Reusable cards are typically made of plastic and therefore may be referred-to as "plastic cards," although the term reusable cards is intended to encompass both plastic cards and cards made of materials other than plastic.

Reusable or plastic cards are treated in a different manner than the conventional paper cards because they are handled more than other table game cards, which creates opportunities for a person to mark the cards and identify the cards during game play when in another player's hand. In order to reuse the cards, it is necessary to verify that they have not been marked, without cancelling or defacing the cards, and to remove marked or damaged cards. As a result, the apparatus of the invention preferably has the ability to identify flaws in a plastic playing card and reject it for manual inspection. The flaws including markings, indents, cuts, holes, graffiti, and any other means that someone has discovered to mark a card in order to gain advantage at the table game.

It will of course be appreciated that the above objectives and description of preferred features is not intended to be limiting, and that embodiments of the invention may achieve all or just some of the listed objectives and advantages, and include all or just some of the features of the preferred embodiment.

DETAILED DESCRIPTION OF THE PREFERRED EMBODIMENTS

Figure 1:
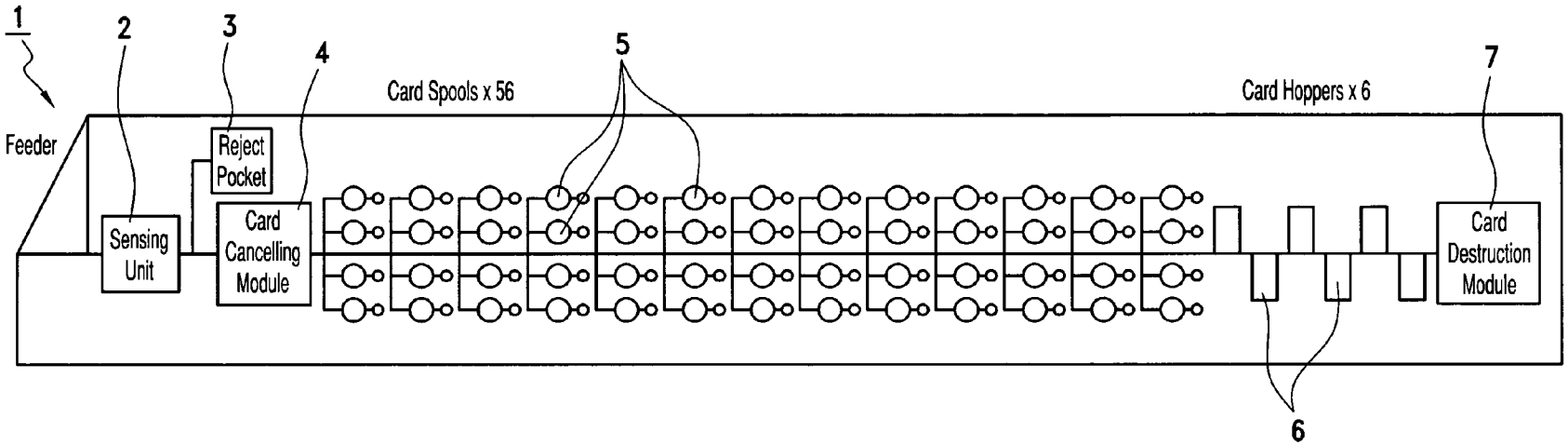
FIG. 1 is a block diagram of a card cancelling/sorting apparatus according to a preferred embodiment of the invention.

As illustrated in FIG. 1, the playing card apparatus of the invention includes an input feeder 1, imaging and/or sensing unit 2, reject pocket 3, card canceling device 4, and a card sorter including escrow or holding devices 5, output pockets 6, and card destruction unit 7. The respective units and devices are preferably linked by transport mechanisms such as belts, pneumatic conveyors, or other sheet feeding mechanisms (not shown) for automatically transporting the cards between and/or within the units or devices, and the units are all preferably including within a single exterior housing (not shown) having a display, and a data/command input device. The housing is preferably a freestanding portable housing on casters, wheels, or the like to allow movement within the card processing room, with the card transport paths being as short and straight as possible to minimize the possibility of jamming or misfeeding. Numerous belts, pneumatic conveyors, or other conveying mechanisms capable of transporting sheet-like materials such as cards are known to those skilled in the art. Open areas may be included in the card paths to provide access to the cards and to permit imaging of both sides of a card. The apparatus further includes one or more controllers, which may include a single central controller, multiple controllers, individual device controllers, an external controller linked to the apparatus through a wired or wireless interface, and so forth, for controlling the apparatus according to the flowcharts of FIGS. 2 and 3.

Cards are input by placing stacks in an appropriately shaped bin or hopper of the input feeder 1, which should be capable of receiving multiple decks of cards, depending on the types of games or other uses for which the cards are intended. For example, casino blackjack games require at least six and possibly up to twelve decks of cards to be processed at one time. The cards are transported to the imaging/sensing unit by a feeder that separates playing cards to allow individual cards to be fed through the transport and images or sensed.

The first unit to which the cards are fed from the input feeder 1 is the imaging/sensor unit 2, which preferably include a camera or other sensing devices for capturing an image of, or data regarding, a whole card or portions of a card in order to identify the card. In the case of playing cards, the imaging unit must be capable of capturing images or data that enable the controller to determine the rank and/or suit of the card, and for determining whether a card has been marked or otherwise is unsuitable of sorting or re-packaging. Rejects may be sent to a reject pocket 3.

Suitable imaging/sensing devices are well known. An example is found in the above-cited U.S. Pat. No. 6,250,632, which uses the imaging to identify rank and suit for the purpose of shuffling cards or reassembling cards into decks by sending the cards to respective one of 52 trays in a predetermined order. Other suitable imaging devices may be adapted from currency or ticket readers.

In addition to imaging devices that permit identification and/or inspection of cards, the preferred apparatus may including sensors for carrying out functions such as card routing, identifying misfeeds or jams, and so forth, as is well-known in the art of document or sheet feeding. For example, the sensors may include barcode readers, scanners, or other imaging devices capable of reading the barcodes on header cards that separate decks into different groups. These sensors may be associated with or independent of the imaging unit 2.

The images or data supplied by the imaging unit 2 to the controller are preferably used not only for card identification, but also for card counting and grading. Card counting is useful for security purposes in order to alert the casino to missing cards that could possibly be used fraudulently, in which case the casino may need to change the cards currently being used, and to ensure that the cards can be sorted into complete decks. Card grading is useful to determine if cards have been damaged in order to determine whether they can be re-packaged, in the case of paper cards, or re-used in the case of plastic or other types of re-useable cards.

The imaging unit 2 is connected to a card cancelling module, a card sorting unit including escrow or holding devices 5 and, optionally, a card destruction unit or shredder 7. The card destruction device may be a conventional shredder, and is used to destroy damaged cards or decks that cannot be re-used or re-packaged.

The card sorting unit includes a mechanism for sorting cards into decks by routing them into individual pockets or trays 6. The terms pockets and trays is intended to encompass pockets, trays, bins, chutes, stackers, or any other structure capable of receiving cards and causing the cards to form decks or stacks in the order received.

It is within the scope of the invention to sort the cards into as many pockets or trays as there are cards in the deck, although it is preferred for simplicity that the number of pockets or trays into which the cards are sorted be less than the total number of cards in a deck, and that the cards instead be held by holding devices 5, which are at least equal in number to a number of different categories into which the cards are to be sorted, or a number of types of cards in a deck. For example, to sort the cards by rank, which is good enough for re-packaged souvenir decks, it is only necessary to include 16 trays for a typical French playing card deck. The card sorter may include "escrow" spools, wheels, or other devices of known type for receiving cards, holding the cards, and supplying the cards to an output in order to supply them to pockets or trays in the proper order. In the illustrated embodiment, the cards are distributed to fixed pockets, although it may be possible to include movable pockets to receive cards exiting the escrow spools.

If escrow or holding devices are used, the transport mechanism must have the ability to send cards to and receive cards from the escrow or holding devices 5 to allow full decks to be developed. During sorting, it is necessary to fan through the cards to find the cards needed to complete a deck. For example, if one is sorting clubs, and one needs a four of clubs in order to complete a deck, one needs to hold cards that cannot be assigned to a pocket until the four is sorted, or until another pocket is cleared to allow the cards to be assigned. Suitable escrow or holding devices include spools of the type presently used in currency recycling machines, although any device of capable of receiving, holding, and dispensing cards under command of a controller may be used.

In addition to sorting decks of cards, the apparatus of the preferred embodiments may also be adapted to process header cards for separating decks into groups, for example, decks originating from different gaming tables, in which case the number and arrangement of escrow spools and trays may be modified as necessary to accommodate the header cards and/or different groups of cards.

The canceling device 4 of the preferred embodiment is preferably positioned in the path of cards moving between the imaging unit and the card sorter, although the cancelling unit may also be positioned within or even at the output of the card sorter. By way of example and not limitation, the cancelling device 4 may include a punch die for rapidly defacing individual cards during transport through the sorter, or a drill for defacing stacks of cards. Depending on the type of cancelling device, it may be necessary to provide a by-pass so that cards can be routed passed the cancelling device. For example, plastic cards may be sorted without cancellation if they are to be reused and have passed inspection for marks or other flaws.

Those skilled in the art will appreciate that other types of card cancelling devices may be substituted for the above-described punch die or drill, including cutting devices for shaving or cutting off parts of the cards, or devices for branding or marking devices for permanently including on the cards a mark indicative of cancellation.

Figure 2:
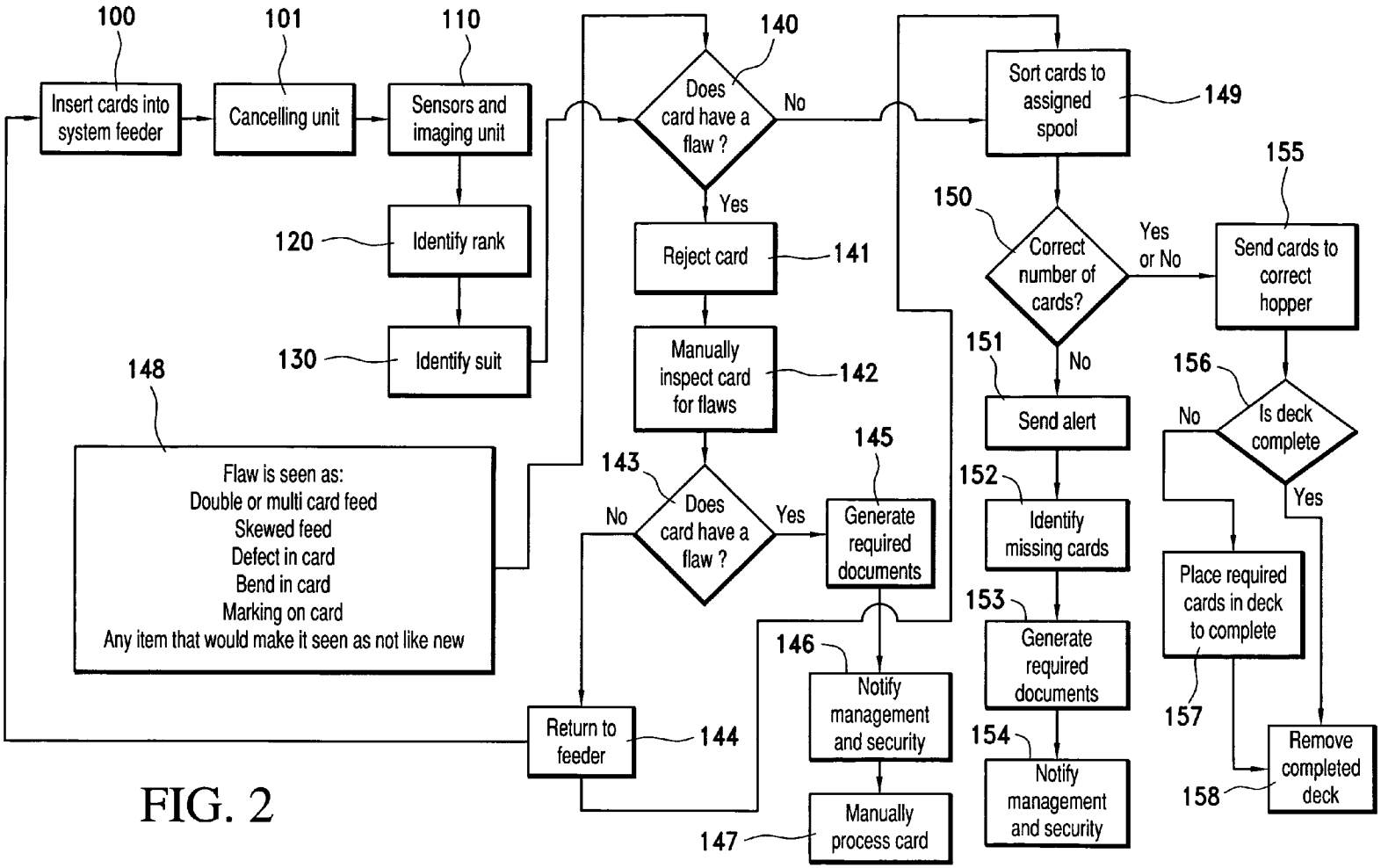
FIG. 2 is a flowchart illustrating the sequence of card handling steps carried out by the apparatus of FIG. 1, in the case of non-reusable cards.

Turning to FIG. 2, the device illustrated in FIG. 1 is operated as follows: First, multiple stacks of cards are placed in the input bin 1 (step 100). Second, images of each card are captured and/or markings or other indicia on the cards are detected (step 110) and the cards are identified by rank (step 120) and suit (step 130).

In addition to identification, the cards are checked for flaws (step 140), and any cards found to have flaws rejected (step 141), manually inspected (steps 142 and 143), and sent to the sorter if no flaw is found (step 144). If flaws are confirmed during manual inspection, appropriate documents/reports are generated (step 145), management or security is notified depending on whether the flaws indicate that the card has been marked (step 146), and other manual steps are taken as necessary (step 147).

The flowchart of FIG. 2 concerns non-reuseable cards, and therefore a cancellation step (step 101) if carried out in addition to the identification, flaw-checking, and sorting steps. Although illustrated as occurring before the sensing and imaging step, the cancellation step may actually occur at any time during between input to the input feeder and distribution to the output pockets, depending on the positioning of the cancelling device 4, as discussed above.

Those skilled in the art will appreciate that the step 140 of checking for flaws may be performed before, during, or after card identification, either as part of the identification process, or as a separate process. Block 148 of the flowchart lists types of flaws, only some of which are defects in the cards themselves. Other flaws include double or multicard feeds and skewed feeds, which may be corrected by simply re-feeding the cards and may not require manual inspection if the feeder has a mis- or multi-feed indicator, and bent cards which may be correctable by flattening the bent cards and refeeding, or which may necessitate disposal of the cards.

If a card passes inspection for flaws, it is sent to the sorter and, unless the card is the next card to be placed in a deck, sent to an escrow or holding device 5 for sorting (step 149). If the card is supposed to be the next card in the deck, or the bottom of the deck in case of a new deck, it may optionally be sent directly to the output pocket or tray, although in the preferred embodiment all of the cards in a deck are held or escrowed until all cards in the feeder 1 have been identified and sent to one of the spools, thereby enabling counting of the cards. If cards are missing, then an alert may be generated (step 151), the missing cards identified (step 152), required documents or reports generated (step 153) and management or security notified (step 154) so that steps can be taken to ensure that the missing cards cannot be used, for example, by changing the cards currently being used to a different card design.

Flawed cards may also be sent to the sorter, but instead of being sent to pockets or trays, the flawed cards are sent to the card destruction device 7, either directly or after escrowing.

In general, multiple decks are processed at the same time, so even if cards are missing, several complete decks may be formed. Therefore, even if the count indicates that cards are missing, once all of the cards in the feeder have been sorted to an appropriate escrow or holding device 5, the cards are retrieved from the holding or escrow device in the order in which they are to be stacked into decks and sent to appropriate output hoppers 6 (step 155) until complete decks are formed (steps 156-158).

Figure 3:
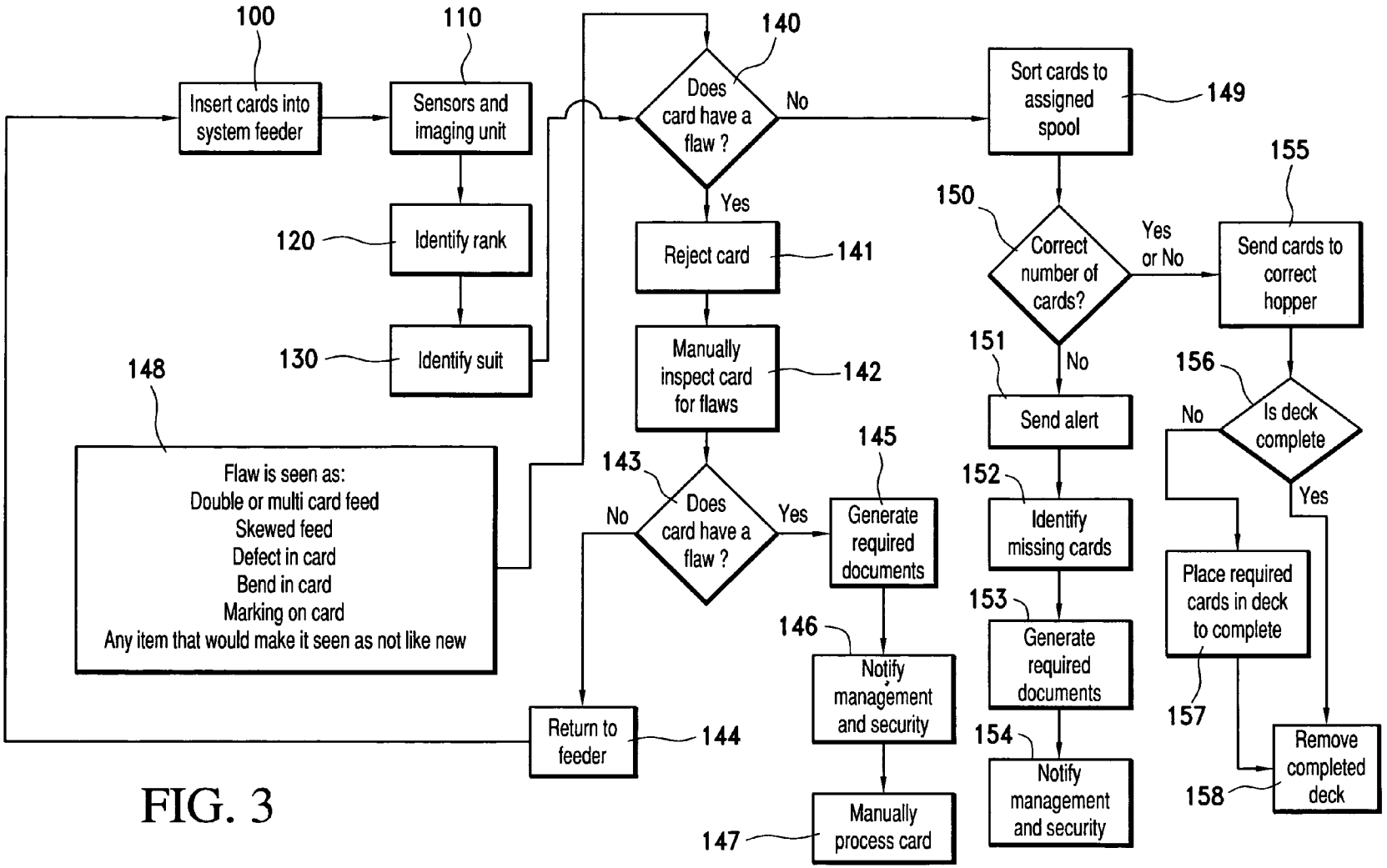
FIG. 3 is a flowchart illustrating the sequence of card handling steps carried out by the apparatus of FIG. 1, in the case of reusable cards.

FIG. 3 shows the manner in which re-usable plastic cards may be handled by the apparatus of FIG. 1. Imaging, verification, and sorting steps 100 to 158 shown in FIG. 3 may be identical to corresponding steps 100 to 158 described above in connection with FIG. 2, with the exception that the cancelling step 101 is omitted.

Having thus described a preferred embodiment of the invention in sufficient detail to enable those skilled in the art to make and use the invention, it will nevertheless be appreciated that numerous variations and modifications of the illustrated embodiment may be made without departing from the spirit of the invention, and it is intended that the invention not be limited by the above description or accompanying drawings, but that it be defined solely in accordance with the appended claims.

We claim:

1. An automatic card cancelling and sorting apparatus, comprising: a card input for inputting a plurality of cards; a card imaging/sensing device arranged to capture images of, or to sense data concerning, each of said plurality of cards; a card cancelling device for defacing a card so that the card can be distinguished from previously-used cards; a card sorting device for distributing cards to at least one pocket; a controller arranged to:

identify each of said cards based on input from said card imaging/sensing device;

cause said card sorting device to distribute cards in a predetermined sequence to said at least one pocket based on identification of said cards; and control said card cancelling device to cancel said cards; and a transport device for transporting said cards from the card input to said card imaging, cancelling, and sorting devices.

2. An automatic card cancelling and sorting apparatus as claimed in claim 1, wherein said card cancelling device includes a punch die.

3. An automatic card cancelling and sorting apparatus as claimed in claim 2, wherein said punch die is in a belt path of the transport and arranged to be engaged during sorting functions that require cancelling of the card.

4. An automatic card cancelling and sorting apparatus as claimed in claim 1, wherein said card cancelling device is situated in a card transport path within said card sorting unit.

5. An automatic card cancelling and sorting apparatus as claimed in claim 1, wherein said cancelling device comprises a cutting device for shaving off one of the edges of the card.

6. An automatic card cancelling and sorting apparatus as claimed in claim 1, further comprising a transport path that by-passes said cancelling device in order to sort cards without cancelling them.

7. An automatic card cancelling and sorting apparatus as claimed in claim 1, wherein said card sorting device includes at least one pocket into which cards are stacked in a predetermined order.

8. An automatic card cancelling and sorting apparatus as claimed in claim 7, wherein a number of said pockets is at least sixteen pockets to permit sorting based on rank.

9. An automatic card cancelling and sorting apparatus as claimed in claim 7, wherein said card sorting device includes a card escrow device for temporarily holding cards prior to placement in one of said pockets.

10. An automatic card cancelling and sorting apparatus as claimed in claim 1, further comprising a shredder for destroying flawed cards.

11. An automatic card sorting apparatus, comprising: a card input for inputting a plurality of cards; a card imaging/sensing device arranged to capture images of, or to sense data Concerning, each of said plurality of cards; a card sorting device for distributing cards to at least one pocket;

a controller arranged to:

identify each of said cards based on input from said card imaging device; and cause said card sorting device to distribute cards in a predetermined sequence to said at least one pocket based on identification of said cards; and a transport device for transporting said cards from the card input to said card imaging and sorting device, wherein said card sorting device includes a plurality of card holding devices arranged to hold said receive and hold said cards before distribution to said at least one pocket so that the cards are distributed to said pocket in a desired order.

12. An automatic card cancelling and sorting apparatus as claimed in claim 11, wherein a number of said card holding devices is at least equal to a number of different types of said cards.

13. An automatic card cancelling and sorting apparatus as claimed in claim 11, wherein said card holding devices are escrow spools.

14. An automatic card cancelling and sorting apparatus as claimed in claim 11, wherein a number of said pockets is at least sixteen pockets to permit sorting based on rank.

15. An automatic card cancelling and sorting apparatus as claimed in claim 11, further comprising a shredder for destroying flawed cards.

16. An automatic card cancelling and sorting apparatus as claimed in claim 11, wherein said card cancelling device includes a punch die.

* * * * *